US008293029B2

(12) United States Patent
Jueptner et al.

(10) Patent No.: US 8,293,029 B2
(45) Date of Patent: Oct. 23, 2012

(54) COLORED CONVERSION LAYERS ON METAL SURFACES

(75) Inventors: Ulrich Jueptner, Hilden (DE); Joerg Becker, Cologne (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 656 days.

(21) Appl. No.: 11/343,664

(22) Filed: Jan. 31, 2006

(65) Prior Publication Data

US 2006/0173099 A1 Aug. 3, 2006

Related U.S. Application Data

(63) Continuation of application No. PCT/EP2004/009212, filed on Aug. 17, 2004.

(30) Foreign Application Priority Data

Aug. 26, 2003 (DE) ..... 103 39 165

(51) Int. Cl.

| | |
|---|---|
| ***C23C 22/34*** | (2006.01) |
| ***C23C 22/40*** | (2006.01) |
| *C23C 22/00* | (2006.01) |

(52) U.S. Cl. ..... 148/247; 148/243; 148/252; 148/250; 148/274; 148/275; 148/283; 106/14.11; 106/14.12; 106/14.13; 106/14.15; 106/14.41; 106/14.42; 106/14.44

(58) Field of Classification Search ..... 148/243, 148/247, 250, 252, 274–275, 283; 106/14.11, 106/14.12, 14.13, 14.15, 14.41, 14.42, 14.44
See application file for complete search history.

(56) References Cited

U.S. PATENT DOCUMENTS

| | | | | |
|---|---|---|---|---|
| 4,992,116 | A | 2/1991 | Hallman | |
| 5,129,967 | A | 7/1992 | Sander et al. | |
| 5,281,282 | A | 1/1994 | Dolan et al. | |
| 5,356,490 | A | 10/1994 | Dolan et al. | |
| 5,584,946 | A | 12/1996 | Karmaschek et al. | |
| 5,891,269 | A * | 4/1999 | Koerner et al. | 148/272 |
| 6,679,943 | B1 * | 1/2004 | Newton et al. | 106/287.14 |
| 6,767,413 | B2 * | 7/2004 | Nishimura | 148/243 |
| 6,875,479 | B2 | 4/2005 | Jung et al. | |
| 2002/0043168 | A1 * | 4/2002 | Mayers et al. | 101/395 |
| 2002/0179189 | A1 * | 12/2002 | Homma et al. | 148/243 |
| 2003/0138567 | A1 | 7/2003 | Schenzle et al. | |
| 2004/0151619 | A1 | 8/2004 | Quellhorst et al. | |

FOREIGN PATENT DOCUMENTS

| | | | |
|---|---|---|---|
| CA | 2 374 539 | A1 | 11/2000 |
| DE | 100 05 113 | A1 | 8/2001 |
| DE | 101 31 723 | A1 | 1/2003 |
| EP | 0 008 942 | B1 | 6/1983 |
| GB | 2343681 | * | 5/2000 |
| WO | WO 92/07973 | A1 | 5/1992 |
| WO | WO 94/12570 | A1 | 6/1994 |
| WO | WO 94/25640 | A1 | 11/1994 |
| WO | WO 94/28193 | A1 | 12/1994 |
| WO | WO 95/04169 | A1 | 5/1995 |
| WO | WO 95/14117 | A1 | 5/1995 |
| WO | WO 00/26437 | A1 | 5/2000 |
| WO | WO 00/71626 | A1 | 11/2000 |
| WO | WO 01/92598 | A1 | 12/2001 |
| WO | WO 02/20652 | A1 | 3/2002 |
| WO | WO 02/31065 | A2 | 4/2002 |

* cited by examiner

*Primary Examiner* — Lois Zheng
(74) *Attorney, Agent, or Firm* — Mary K. Cameron

(57) ABSTRACT

Chromium-free conversion coating treatment solutions and processes for depositing a colored layer on zinc or galvanized steel, aluminum, magnesium or their alloys, are provided comprising: hexafluorotitanate and/or hexafluorozirconate ions; molybdate and/or tungstate ions; one or more chelating complex formers; and a copolymer of alkylene phosphonic or alkylene phosphinic acid and one or more unsaturated carboxylic acids.

18 Claims, No Drawings

COLORED CONVERSION LAYERS ON METAL SURFACES

CROSS-REFERENCE TO RELATED APPLICATION

This application is a continuation under 35 USC Sections 365(c) and 120 of International Application No. PCT/EP2004/009212, filed 17 Aug. 2004 and published 10 Mar. 2005 as WO 2005/021834, which claims priority from German Application No. 103 39 165.7 filed 26 Aug. 2003, each of which is incorporated herein by reference in its entirety.

FIELD OF THE INVENTION

The invention lies in the field of chemical surface treatment of zinc or galvanized steel, aluminum, magnesium or their alloys. It describes chromium-free conversion processes for such metal surfaces, i.e. chemical treatment processes that afford a surface layer, into which both cations from the treated metal surface and also ions from the treatment solution are incorporated. The chromium-free layer is colored, thus, by means of a simple visual control, it can be determined whether an adequate conversion layer has been formed. The function of this conversion layer is to reduce the tendency of the metal surface to corrode and to prepare a good adhesion between the metal surface and an organic coating, such as, for example, a paint or an adhesive, deposited on the conversion layer.

BACKGROUND OF THE INVENTION

An extensive prior art exists for the manufacture of chromium-free conversion layers on the abovementioned metal surfaces.

U.S. Pat. No. 5,129,967 discloses treatment baths for a no-rinse treatment of aluminum (described as "dried in place conversion coating"), comprising a) 10 to 16 g/l polyacrylic acid or homopolymers thereof,
b) 12 to 19 g/l of hexafluorozirconic acid,
c) 0.17 to 0.3 g/l of hydrofluoric acid and
d) up to 0.6 g/l of hexafluorotitanic acid.

EP-B-8 942 discloses treatment solutions, preferably for aluminum tins, comprising a) 0.5 to 10 g/l polyacrylic acid or an ester thereof and
b) 0.2 to 8 g/l of at least one of the compounds $H_2ZrF_6$, $H_2TiF_6$ and $H_2SiF_6$, wherein the pH of the solution is below 3.5.

Additional polymers that can be used in similar treatment baths are listed in WO 02/20652.

U.S. Pat. No. 4,992,116 describes treatment baths for the conversion treatment of aluminum at pH values between about 2.5 and 5 and which comprise at least three components:

a) phosphate ions in concentrations between $1.1\times10^{-5}$ to $5.3\times10^{-3}$ mol/l corresponding to 1 to 500 mg/l,
b) $1.1\times10^{-5}$ to $1.3\times10^{-3}$ mol/l of a fluoric acid of an element of the group Zr, Ti, Hf and Si (corresponding to 1.6 to 380 mg/l, depending on the element) and
c) 0.26 to 20 g/l of a polyphenolic compound, obtained from the reaction of polyvinyl phenol with aldehydes and organic amines.

WO 92/07973 teaches a chromium-free treatment process for aluminum, which uses 0.01 to about 18 wt. % H2ZrF6 and 0.01 to about 10 wt. % of a 3-(N—C1-4 alkyl-N-2-hydroxyethylaminomethyl)-4-hydroxystyrene polymer in acidic aqueous solution as the major components. Optional components are 0.05 to 10 wt. % dispersed SiO2, 0.06 to 0.6 wt. % of a solubilizer for the polymer as well as surfactant. The cited polymer falls in the group described below of suitable "reaction products of polyvinyl phenol with aldehydes and organic amines containing hydroxy groups" in the context of the present invention.

WO 94/28193 describes a process for the pretreatment of aluminum surfaces or its alloys prior to a second, permanently corrosion-protective conversion treatment, wherein the surfaces are contacted with acidic, aqueous treatment solutions that comprise fluorine complexes of the elements boron, silicon, titanium, zirconium or hafnium alone or in mixtures with fluorine anion concentrations totaling between 100 and 4000, preferably 200 to 2000 mg/l and have a pH between 0.3 and 3.5, preferably 1 and 3.

Thereby the treatment solutions may comprise additional polymers of the type of polyacrylates and/or the reaction products of polyvinyl phenol with aldehydes and organic amines containing hydroxy groups in concentrations below 500 mg/l, preferably below 200 mg/l. Further possible components of the treatment baths are polyhydroxycarboxylic acids or their anions, particularly gluconate ions, in concentrations up to 500 mg/l.

WO 95/04169 teaches the treatment of metal surfaces with a treatment solution that comprises the following components: Fluoro complexes of titanium, zirconium, hafnium, silicon, aluminum and boron, metal ions selected from cobalt, manganese, zinc, nickel, tin, copper, zirconium, iron and strontium, phosphates or phosphonates as well as water-soluble or water-dispersible organic film formers.

WO 00/71626 discloses a chromium-free anti-corrosive, comprising water and a.) 0.5 to 100 g/l hexafluoride anions of titanium (IV), silicon (IV) and/or zirconium (IV)
b.) 0 to 100 g/l phosphoric acid
c.) 0 to 100 g/l of one or a plurality of compounds of cobalt, nickel, vanadium, iron, manganese, molybdenum or tungsten.
d.) 0.5 to 30 wt. % of at least one water-soluble or water-dispersible film-forming organic polymer or copolymer (based on the active substance),
e.) 0.1 to 10 wt. % of an organophosphonic acid
f.) optional additional auxiliaries and additives.

In the abovementioned documents, in many cases it is obvious that the produced conversion layers are colorless and transparent, such that the treated metal surfaces appear metallic bright. At least, it was never disclosed in these documents that colored structures were obtained. However, from many years of experience with chromating, the expert is accustomed to obtaining a colored layer from the conversion treatment. He or she can then immediately recognize visually whether the treatment has produced the desired success. When manufacturing colorless layers, however, a more complex surface analysis is required, for example the determination of the Ti content of the surface by means of an X-ray fluorescence measurement. There is therefore a practical need for surface treatment processes that not only provide similarly good anti-corrosion properties and paint adhesion as with conventional chromium-containing layers, but also layers, similar to those chromium-containing layers, which are visible to the human eye.

Approaches for solving this problem exist in the prior art. For example, WO 94/25640 discloses a process for the production of blue-colored conversion layers on zinc/aluminum-alloys. The metal surfaces are contacted with a treatment solution at a pH between 3.5 and 6 with a 0.2 to 3.0 wt. % molybdenum content and a fluoride content of 0.1 to 2.0 wt. %. Molybdenum can be used in the form of molybdate, as phosphomolybdenic acid, as molybdenum chloride and such. Fluoride can be used in the form of hydrofluoric acid, simple fluorides, but also as complex fluoro acids such as for example fluorotitanic acid or fluorozirconic acid.

A similar treatment process is described in WO 95/14117, although no mention is made there of the optical appearance of the conversion layers. According to this document, the treatment solution comprises heterooxo anions of molybdenum, tungsten or vanadium with one of the heteroions phosphorus, aluminum, silicon, manganese, zirconium, titanium, cerium or nickel. Moreover, the treatment solution comprises an organic film-builder, which for example, can be selected from acrylates. The heterooxo anions, for example anions of heteropoly acids, can be formed directly in the treatment solution, in which one adds the starting products for them, for example molybdate ions and phosphoric acid. In addition, the treatment solution should preferably comprise a corrosive for aluminum, e.g. fluoride, tetrafluoroborate or similarly acting corrosives.

The teaching of WO 00/26437 follows the path of dyeing the conversion layer with an organic dye (alizarin dye). The conversion layer itself is produced with a treatment solution that comprises complex fluorides, for example of titanium and zirconium besides additional inorganic oxides, hydroxides or carbonates or their reaction products with the fluoric acids. In addition, poly-4-hydroxystyrene (polyvinyl phenol), substituted with amino groups, can be present as the organic polymer.

SUMMARY OF THE INVENTION

It is an object of the invention to provide surface treatments compositions and processes for applying same which overcome the drawbacks of the prior art.

It is an object of the invention provide an aqueous treatment solution for the production of colored layers on surfaces of zinc, aluminum, magnesium or their alloys, which has a pH value in the range of 1 to 6 and which contains a) a total of 4 to 4000 mg/l of hexafluorotitanate and/or hexafluorozirconate ions,
b) a total of 10 to 4000 mg/l of molybdate and/or tungstate ions, calculated as dihydrate of the Na salt,
c) a total of 1 to 2000 mg/l of one or more chelating complex formers,
d) 0.04 to 40 mg/l of a copolymer of alkylene phosphonic or alkylene phosphinic acid and one or more unsaturated carboxylic acids.

Desirably the aqueous treatment solution is characterised in that the concentration of the hexafluorotitanate and/or hexafluorozirconate ions a) is at least 30 mg/l, preferably at least 100 mg/l in total and/or the concentration of the molybdate and/or tungstate ions, calculated as dihydrate of the Na salt b) is at least 50 mg/l, preferably at least 100 mg/l in total and/or, the total concentration of the one or more chelating complex formers c) is at least 5 mg/l, preferably at least 15 mg/l in total and/or the concentration of the copolymer of alkylene phosphonic or alkylene phosphinic acid and one or more unsaturated carboxylic acid(s) d) is at least 0.2 mg/l, preferably at least 0.5 mg/l. It is also desirable that in the aqueous treatment solution the concentration of the hexafluorotitanate and/or hexafluorozirconate ions a) is a maximum of 1000 mg/l, preferably a maximum of 500 mg/l in total and/or the concentration of the molybdate and/or tungstate ions, calculated as dihydrate of the Na salt b) is a maximum of 2000 mg/l, preferably a maximum of 1000 mg/l in total and/or the total concentration of the one or more chelating complex formers c) is a maximum of 1000 mg/l, preferably a maximum of 300 mg/l in total and/or the concentration of the copolymer of alkylene phosphonic or alkylene phosphinic acid and one or more unsaturated carboxylic acid(s) d) is a maximum of 10 mg/l, preferably a maximum of 5 mg/l.

In one aspect of the invention, the aqueous treatment solution additionally contains one or more other polymers that do not fall within group d) and that are selected from:

e) polyvinyl alcohol or water-soluble or water-dispersible partial esters thereof in a concentration of at least 1 mg/l, preferably of at least 10 mg/l, in particular of at least 20 mg/l and of at most of 1000 mg/l, preferably of at most 500 mg/l, in particular of at most 200 mg/l,
f) polymers or copolymers of unsaturated mono or dicarboxylic acids or their amides, in a concentration of at least 1 mg/l, preferably of at least 10 mg/l, in particular of at least 30 mg/l and of at most 2000 mg/l, preferably of at most 500 mg/l, in particular of at most 300 mg/l
g) esters of the polymers of groups e) and f) in a concentration of at least 1 mg/l, preferably of at least 10 mg/l, in particular of at least 30 mg/l and of at most 2000 mg/l, preferably of at most 500 mg/l, in particular of at most 300 mg/l,
h) 0.01 to 20 g/l of a polymer of copolymer of vinyl pyrrolidone,
i) amine-substituted polymers of 4-hydroxystyrene in a concentration of at least 1 mg/l, preferably of at least 10 mg/l, in particular of at least 30 mg/l and of at most 2000 mg/l, preferably of at most 500 mg/l, in particular of at most 300 mg/l,
j) polymers of the diglycidyl ether of bisphenol A in a concentration of at least 1 mg/l, preferably of at least 10 mg/l, in particular of at least 30 mg/l and of at most 2000 mg/l, preferably of at most 500 mg/l, in particular of at most 300 mg/l.

Desirably the aqueous treatment solution contains at least one polymer or copolymer f) that is selected from maleic acid-methylvinylether copolymers and from polymers or copolymers of acrylic acid and/or methacrylic acid, of which the carboxyl groups are at least partially replaced by amide groups, or of which the esters are replaced with polyvinyl alcohol as polymer g).

In another aspect of the invention, an aqueous concentrate for the production or supplementation of an aqueous treatment solution as disclosed herein is provided that contains:

b) a total of 2 to 200 g/l molybdate and/or tungstate ions, calculated as dihydrate of the Na salt,
c) a total of 0.5 to 200 g/l of one or more chelatising complex formers,
d) 0.02 to 5 g/l of a copolymer of alkylene phosphonic or alkylene phosphinic acid and one or more unsaturated carboxylic acid(s).

In one embodiment of the invention, an aqueous treatment solution and a concentrate therefor are provided in which the chelating complex former c) is selected from molecules with 2 or more phosphonic acid groups, preferably from geminal diphosphonic acids and phosphono carboxylic acids and their respective anions.

In another embodiment of the invention, an aqueous treatment solution and a concentrate therefor are provided in which the copolymer d) is selected from copolymers of vinylphosphonic acid and one or more unsaturated carboxylic acids selected from acrylic acid, methacrylic acid and maleic acid.

In another aspect of the invention, a process for the production of colored layers on surfaces of zinc, aluminum, magnesium or their alloys is provided, wherein the surfaces are brought into contact in a spray or dipprocess, for a period in the range of 2 seconds to 10 minutes, with an aqueous treatment solution according to the invention described herein, which has a temperature in the range of 10 to 70° C. The invention also includes products made according to this process, e.g. metal bands, metal sheets or metal components, which have surfaces of zinc, aluminum, magnesium or their alloys and which bear on these surfaces colored layers produced by a process according to the invention.

DETAILED DESCRIPTION OF THE INVENTION

In a first aspect, the present invention relates to an aqueous treatment solution for the production of colored layers on surfaces of zinc, aluminum, magnesium or their alloys, which has a pH in the range 1 to 6 and which comprises a) a total of 4 to 4000 mg/l hexafluorotitanate and/or hexafluorozirconate ions,
b) a total of 10 to 4000 mg/l molybdate and/or tungstate ions, calculated as the dihydrate of the sodium salt,
c) a total of 1 to 2000 mg/l of one or more chelating complex formers,
d) 0.04 to 40 mg/l of a copolymer of alkylene phosphonic or alkylene phosphinic acid and one or more unsaturated carboxylic acids.

The metal surfaces can be the surfaces of the cited metals or their alloys as such, but also surfaces of a substrate such as steel, for example, that is plated with the cited metals or their alloys. Examples of the latter are electrolytically galvanized or hot dip galvanized steel, aluminized steel, or coated steels like Galvalume® or Galfan® that have a coating of a zinc/aluminum alloy.

Preferably, the treatment solution is free of chromium. In addition, it preferably contains no heavy metal ions other than those listed as components a) and b). This reduces the requirements for any wastewater treatment.

The pH of the treatment solution should not decrease much below 1 as lower pH values lead to an increasingly stronger etching attack on the metal surface. Preferably, the pH is not lower than 2 and in particular, not lower than 2.5. At pH values above the cited limit of 6, the conversion layer is no longer formed adequately. Preferably, one works at pH values not higher than 4 and in particular, not higher than 3.5.

The abovementioned essential components a) through d), all illustrate protolytes, i.e. molecules or ions that in the sense of an acid-base reaction can react with the elimination or addition of protons. It is obvious to the expert that these components undergo such reactions among themselves and with the water solvent until the corresponding chemical equilibria are attained. It is expected that in the cited pH range, all these protolytes are present in a partially protolyzed state, independently of whether they were introduced into the treatment solution in the form of acids or their salts. Preferably, the cited pH values are adjusted to the acidic range by introducing the hexafluorotitanate and/or hexafluorozirconate ions in the form of the free acids. An additional acid to set the acidic pH value is then not needed. However, these complex fluoride ions could be added in the form of their salts and then adjusted to the desired pH by adding a further acid, such as for example nitric acid.

On economic grounds, the molybdate and/or tungstate ions are preferably added in the form of their salts, for example as the sodium salts. The chelating complex formers and the copolymer of group d) may also be added in the form of their free acids or in the form of ammonium or alkali metal salts. This is primarily a question of commercial availability. For the case that the desired pH is not automatically generated on mixing the essential components with water, then the pH can be lowered by adding an acid, for example nitric acid, or raised by adding an alkali such as sodium hydroxide.

The definition of the chelating complex former c) is to be understood such that it represents another compound than the copolymer mentioned under d), even though these could also have chelating properties. The chelating complex formers c) should rather preferably be non-polymeric molecules.

For the concentrations of the active components a) through d) it is generally true that below the cited minimum concentrations, the quality of the layer gradually decreases. Overshooting the cited highest concentrations is not normally detrimental, but results in no significant advantage and is therefore uneconomical. Preferably, the lowest concentration for component a) is 30 mg/l and particularly 100 mg/l, for component b) 50 mg/l, particularly 100 mg/l, for component c) 5 mg/l, particularly 15 mg/l and for component d) 0.2 mg/l, particularly 0.5 mg/l. In this respect, the cited minimum concentrations of the individual components are independent of one another. However, all four of the components are preferably present in the cited lowest concentrations. This is also true for the preferred maximum concentrations of the individual components, which are as follows: Component a) has preferably a maximum concentration of 1000 mg/l, particularly 500 mg/l, component b) has preferably a maximum concentration of 2000 mg/l, particularly 1000 mg/l, component c) has preferably a maximum concentration of 1000 mg/l, particularly 300 mg/l and component d) has preferably a maximum concentration of 10 mg/l, particularly 5 mg/l.

The treatment solution can additionally comprise one or a plurality of additional polymers, which do not belong to group d) and which are known from the prior art for the treatment of the cited metal surfaces in combination with titanium or zirconium hexafluoroates. These additional polymers can be selected from:

e) polyvinyl alcohol or water-soluble or water-dispersible partial esters thereof in a concentration of at least 1 mg/l, preferably at least 10 mg/l, particularly at least 20 mg/l and at most 1000 mg/l, preferably at most 500 mg/l, particularly at most 200 mg/l;
f) polymers or copolymers of unsaturated mono or dicarboxylic acids or their amides in a concentration of at least 1 mg/l, preferably at least 10 mg/l, particularly at least 30 mg/l and at most 2000 mg/l, preferably at most 500 mg/l, particularly at most 300 mg/l;
g) esters of the polymers of group e) and f) in a concentration of at least 1 mg/l, preferably at least 10 mg/l, particularly at least 30 mg/l and at most 2000 mg/l, preferably at most 500 mg/l, particularly at most 300 mg/l;
h) 0.01 to 20 g/l of a polymer or copolymer of vinyl pyrrolidone;
i) amine substituted polymers of 4-hydroxystyrene in a concentration of at least 1 mg/l, preferably at least 10 mg/l, particularly at least 30 mg/l and at most 2000 mg/l, preferably at most 500 mg/l, particularly at most 300 mg/l; and
j) polymers of the diglycidyl ether of Bisphenol A in a concentration of at least 1 mg/l, preferably at least 10 mg/l, particularly at least 30 mg/l and at most 2000 mg/l, preferably at most 500 mg/l, particularly at most 300 mg/l.

For polymers of group e), "partial esters" are understood to mean that only a part of the alcohol groups is esterified, the ester formation resulting from non-polymeric carboxylic acids. In particular, the esterification can be effected with monobasic carboxylic acids having 1 to 4 carbon atoms.

The polymers or copolymers of group f) can be selected from homopolymers and copolymers of acrylic acid and/or methacrylic acid, the acid groups of which being partially substituted with amide groups or esterified with alcohols, particularly with simple alcohols having 1 to 4 carbon atoms. Specific examples are homopolymers and copolymers of or with methyl methacrylate, n-butyl acrylate, hydroxyethyl acrylate and glycerol propoxy triacrylate. These specific examples are known from WO 95/14117, for example. In addition, the polymers of group f) can be selected from those that comprise maleic acid monomers. A specific example here is a maleic acid-methyl vinyl ether copolymer.

Preferably, the treatment solution comprises both polymers from group e) as well as those from group f). In this case, it is particularly preferred that the polymer from group f) is a maleic acid-methyl vinyl ether copolymer.

Polymers of group e) generally comprise free alcohol groups, those from group f) free carboxylic acid groups. Thus, both these polymers can not only be added together in a blend, but also in a form in which at least a partial esterification of the alcohol groups of the polymer e) with the carboxylic acid groups of polymer f) has occurred. This is discussed in more detail in WO 94/12570. The described teaching is also applicable in the context of the present invention.

In addition, the treatment solution can comprise polymers of group h). Such polymers and their use in treatment solutions for the conversion treatment are described in more detail in DE-A-100 05 113 and DE-A-101 31 723.

Moreover, the additional polymers can be selected from those of group i), amine substituted polymers of 4-hydroxystyrene, which to some extent are designated as polymers of polyvinyl phenol. Examples can be found in WO 00/26437 and the literature cited therein, such as in particular the U.S. Pat. No. 5,281,282.

Moreover, the additional polymers can be selected from those of group j), as is described in more detail in U.S. Pat. No. 5,356,490.

In principle, the inventive treatment solutions can be prepared by dissolving the individual components in the required concentrations on site. However, in practice it is generally the case that aqueous concentrates of the treatment solution are made available and diluted with water to the required concentration by the end-user on site or used to replenish a used treatment solution with active principles. In this case, a concentrate that can be used to make or replenish the treatment solution and which comprises all the essential and optional components is less storage stable. In fact it proves advantageous to make available at least two separate concentrates, wherein one comprises the components b), c) and d) and when needed, additional optional components, the other comprising the components a), likewise, when needed, together with optional components. Examples of concentrates of the last type are known in the prior art, for example in the literature mentioned above.

In a further aspect, the invention includes a concentrate, i.e. an aqueous concentrate for the production or supplementation of an aqueous treatment solution as described and claimed herein that contains:

b) a total of 2 to 200 g/l molybdate and/or tungstate ions, calculated as the dihydrate of the sodium salt, c) a total of 0.5 to 200 g/l of one or more chelating complex formers, d) 0.02 to 5 g/l of a copolymer of alkylene phosphonic or alkylene phosphinic acid and one or more unsaturated carboxylic acids.

In the treatment solution or the concentrates, the chelating complex former c) is preferably non polymeric and preferably selected from molecules having 2 or more phosphonic acid groups, particularly from geminal diphosphonic acids, and phospho-carboxylic acids and respectively their anions. (As discussed above, the corresponding acid-base equilibrium between the acid form and the salt form of the complex former will be reached in the treatment solution and in the concentrate according to the pH, independently of which form was added to the solution or the concentrate.)

Examples of this type of complex formers are:

1-hydroxy-1-phenylmethane-1,1-diphosphonic acid;
1-hydroxy-1-phenylmethane-1,1-diphosphonic acid $2H_2O$;
p-hydroxyphenyl-1-aminomethane-1,1-diphosphonic acid;
p-hydroxyphenyl-1-hydroxymethane-1,1-diphosphonic acid.$H_2O$;
1-hydroxy-1-phenylmethane-1,1-diphosphonic acid.$H_2O$, $Na_2$ salt;
1-hydroxyphenylmethane-1,1-diphosphonic acid.$H_2O$;
1-amino-1-phenylmethane-1,1-diphosphonic acid;
4-aminophenyl-1-hydroxymethane-1,1-diphosphonic acid.$H_2O$;
p-aminophenyl-1-aminomethane-1,1-diphosphonic acid;
p-chlorophenylmethane-1,1-diphosphonic acid;
1-chloro-1-phenylmethane-1,1-diphosphonic acid.$2H_2O$;
p-chlorophenyl-1-hydroxymethane-1,1-diphosphonic acid.$2H_20$;
1-chlorophenylmethane-1,1-diphosphonic acid.$H_2O$;
p-chlorophenyl-1-chloromethane-1,1-diphosphonic acid;
4-chlorophenyl-1-chloromethane diphosphonic acid.$2H_2O$;
p-hydroxyphenylaminomethylene diphosphonic acid, $Na_2$ salt;
p-hydroxyphenyl-1-aminomethane-1,1-diphosphonic acid, containing methylol;
3,4-dimethylphenyl-1-chloromethane diphosphonic acid;
3,4-dimethylphenyl-1-hydroxymethane diphosphonic acid;
3,4-dimethylphenylaminomethane diphosphonic acid;
3,4-dimethylphenyl-1-chloromethane-1,1-diphosphonic acid $2H_2O$;
4-dimethylaminophenyl-1-hydroxymethane diphosphonic acid;
4-(N-benzyl-N,N-dimethylamino)-phenyl-1-hydroxymethane diphosphonic acid;
4-trimethylaminophenyl-1-hydroxymethane diphosphonic acid;
3,4,5-trimethoxyphenyl-1-aminomethane-1,1-diphosphonic acid;
1-bis-(N-hydroxymethyl)-amino-1-phenylmethane-1,1-diphosphonic acid;
3,5-dichloro-4-hydroxyphenyl-hydroxymethane diphosphonic acid;
3,5-dibromo-4-hydroxyphenyl-aminomethane diphosphonic acid;
1-amino-1-cyclohexylmethane-1,1-diphosphonic acid;
1-hydroxy-1-cyclohexylmethane-1,1-diphosphonic acid, Na salt;
1-hydroxy-1-cyclohexylmethane-1,1-diphosphonic acid, $Na_3$ salt;
[4-(aminomethyl)-cyclohexyl]-1-hydroxymethane-1,1-diphosphonic acid;
4-methoxybenzoylacetonitrile, phosphonylated;
N-(hydroxymethyl)-1-aminoethane-1,1-diphosphonic acid;
1,3-diaminopropane-1,1-diphosphonic acid;
3-dimethylamino-1-aminopropane-1,1-diphophonc acid;
3-monomethylamino-1-aminopropane-1,1-diphosphonic acid;
3-(N-dodecylamino)-1-aminopropane-1,1-diphophonc acid;

3-(N,N-dodecylmethylamino)-1-aminopropane-1,1-diphosphonic acid;
3-(N-dodecylamino)-1-aminopropane-1,1-diphosphonc acid.HX (X=halogen);
3-(N-dimethyldodecylamino)-1-aminopropane-1,1-diphosphonic acid.methyl iodide;
2-amino-2-methyl-1-hydroxypropane-1,1-diphosphonic acid;
3-amino-1-hydroxy-3-phenylpropane-1,1-diphosphonic acid;
3-amino-3-phenyl-1-hydroxypropane-1,1-diphosphonic acid;
3-diethylamino-1-hydroxypropane-1,1-diphosphonic acid;
3-N,N-dimethylamino-1-hydroxypropane-1,1-diphosphonic acid;
3-N-bis-(hydroxyethyl)-amino-1-hydroxypropane-1,1-diphosphonic acid;
3-(N-dodecylamino)-1-hydroxypropane-1,1-diphosphonic acid;
1,3-dihydroxy-3-phenylpropane-1,1-diphosphonic acid;
3-dimethylamino-1-hydroxypropane-1,1-diphosphonic acid, Na salt;
1,3-dihydroxypropane-1,1-diphosphonic acid, $Na_2$ salt;
1-hydroxy-3-diethylaminopropane-1,1-diphosphonc acid, Na salt;
1,3-dihydroxy-3-phenylpropane-1,1-diphosphonic acid, $Na_2$ salt;
1,3-diaminobutane-1,1-diphosphonic acid;
1-hydroxy-3-aminobutane-1,1-diphosphonic acid;
3-monoethylamino-1-aminobutane-1,1-diphosphonic acid;
4-amino-1-hydroxybutane-1,1-diphosphonic acid;
4-N,N-dimethylamino-1-hydroxybutane-1,1-diphosphonic acid;
6-amino-1-hydroxyhexane-1,1-diphosphonic acid;
1,6-dihydroxyhexane-1,1-diphosphonic acid;
1,6-dihydroxyhexane-1,1-diphosphonic acid, $Na_2$ salt;
1,11-dihydroxyundecane-1,1-diphosphonic acid;
11-amino-1-hydroxyundecane-1,1-diphosphonic acid;
t-1,2-diaminocyclohexane-tetrakis(methylenephosphonic acid);
glucamine-bis(methylenephosphonic acid);
glucamine-bis(methylenephosphonic acid), Na salt;
1-ureidoethane-1,1-diphosphonic acid;
pyrimidyl-2-aminomethane diphosphonic acid;
pyridyl-2-aminomethylene diphosphonic acid;
N,N'-dimethylureidomethane diphosphonic acid;
N-(2-hydroxyethyl)ethylenediamine-N,N',N'-trismethylenephosphonic acid;
N-(2-hydroxyethyl)ethylenediamine-N, N'N'-trismethylenephosphonic acid.$H_2O$;
aminoacetic acid-N,N-dimethylenephosphonic acid;
1,2-diaminopropane-tetrakis(methylenephosphonic acid);
2-hydroxypropane-1,3-diamine-tetrakis(methylenephosphonic acid);
5-hydroxy-3-oxa-1-aminopentane-bis(methylenephosphonic acid);
imino-bis(methylenephosphonic acid);
nitrosamine of imino-bis(methylenephosphonic acid); nitrosamine of imino-bis(methylenephosphonic acid), Na, salt;
γ,γ-diphosphono-N-methylbutyrolactam;
amidinomethylene diphosphonic acid;
formylaminomethane diphosphonic acid;
2-iminopiperidone-6,6-diphosphonic acid.$H_2O$;
2-iminopyrrolidone-5,5-diphosponic acid;
N,N'-dimethyliminopyrrolidone-5,5-diphosphonic acid;
1-methyl-2-pyrrolidone-5,5-diphosphonic acid;
aminodiacetic acid-N-methylphosphonic acid;
1,3-dihydroxy-2-methylpropane-N,N-dimethylenephosphonic acid;
1,2-dihydroxypropane-3-amino-bis(methylenephosphonic acid);
2-hydroxypropane-1,3-diamine-tetrakis(methylenephosphonic acid);
3,6-dioxa-1,8-diaminooctane-tetrakis(methylenephosphonic acid);
1,5-diaminopentane-tetrakis(methylenephosphonic acid);
methylamino-dimethylenephosphonic acid;
N-hexylamino-dimethylenephosphonic acid;
decyclamino-dimethylenephosphonic acid;
3-picolylaminodimethylenephosphonic acid.$H_2O$;
methanediphosphonic acid;
methanediphosphonic acid $H_2O$, $Na_2$ salt;
dichloromethanediphosphonic acid.$5H_2O$, $Na_2$ salt;
tetraisopropyl dichloromethanediphosphonate;
1,1-diphosphonethane-2-carboxylic acid;
ethane-1,1-diphosphonic acid;
ethane-1,1-diphosphonic acid, $Na_4$ salt;
ethane-1,2-diphosphonic acid;
ethane-1,1,2-triphosphonic acid;
ethylenediphosphonic acid, $Na_4$ salt;
1,2-diphosphonoethane-1,2-dicarboxylic acid;
1,2-diphosphonoethane-1.2-diaarboxylic acid.$2H_2O$;
ethane-1,1,2,2-tetraphosphonic acid.$H_2O$, hexaguanidine salt;
ethane-1,1,2,2-tetraphosphonic acid, hexaguanidine salt;
ethane-1,1,2,2-tetraphosphonic acid, guanidine salt;
1-phosphonoethane-1,2,2-tricarboxylic acid, K salt;
phosphonoacetic acid;
α-chloro-α-phosphonoacetic acid;
α-phosphonoacetic acid;
1-phosphonopropane-2,3-dicarboxylic acid;
1-phosphonopropane-1,2,3-tricarboxylic acid, $Na_5$ salt;
1-phosphonopropane-1,2,3-tricarboxylic acid.$H_2O$;
propane-1,1,3,3-tetraphosphonic acid, $Na_6$ salt;
aminomethane diphosphonic acid;
dimethylaminomethane diphosphonic acid;
N-decylaminomethane-1,1-diphosphonic acid;
N-decylaminomethane diphosphonic acid;
N,N-dimethylaminomethanediphosphonic acid monohydrate;
dimethylaminomethane diphosphonic acid, $Na_2$ salt;
N-decylaminomethane diphosphonic acid, $Na_4$ salt;
1-aminoethane-1,1-diphosphonic acid;
1-amino-2-chloroethane-1,1-diphosphonic acid;
1-amino-2-phenylethane-1,1-diphosphonic acid;
1-monomethylaminoethane-1,1-diphosphonic acid;
N-monohydroxymethylaminoethane-1,1-diphosphonic acid;
1-aminopropane-1,1-diphosphonic acid;
1-aminopropane-1,1,3-triphosphonic acid;
1-aminobutane-1,1-diphosphonic acid;
1-aminohexane-1,1-diphosphonic acid;
1-aminodecane-1,1-diphosphonic acid;
1-aminohexadecane-1,1-diphosphonic acid;
1-hydroxy-3,6,9-trioxadecane-1,1-diphosphonic acid, $Na_3$ salt;
coco alkylaminobis(methylene phosphonic acid);
4-ethyl-4-methyl-3-oxo-1-aminohexane-1,1-diphosphonic acid;
1-hydroxy-3-oxo-4-ethyl-4-methylhexane-1,1-diphosphonic acid;
1-amino-4-ethyl-4-methyl-3-oxohexane-1,1-diphosphonic acid;
1-hydroxy-3-oxo-4-ethyl-4-methylhexane-1,1-diphosphonic acid.$H_2O$, Na salt;

4-ethyl-4-methyl-3-oxohex-1-ene-1,1-diphosphonc acid;
4-methyl-4-ethyl-3-oxohex-1-ene-1,1-diphosphonic acid, $Na_4$ salt;
1-amino-3-oxo-4,4-dimethylheptane-1,1-diphosphonic acid;
1-hydroxy-3-oxo-4,4-dimethylheptane-1,1-diphosphonic acid.$H_2O$, Na salt;
4,4-dimethyl-3-oxo-hept-1-ene-1,1-diphosphonic acid;
4,4-dimethyl-3-oxo-hept-1-ene-1,1-diphosphonic acid, Na salt;
1-amino-3-oxo-4,4-dimethyldecane-1,1-diphosphonic acid;
aminomethane monophosphonic acid;
toluylaminomethane phosphinic acid;
p-hydroxyphenyl-1-aminomethanephosphonic acid semihydrochloride;
N-ethylamino-(phenylmethanediphosphonic acid);
1-benzylamino-1-phenylmethane-1-phosphonic acid;
1-hydroxyethane monophosphonic acid;
1-hydroxyethane-1-monophosphonic acid, Na salt;
1-hydroxyethane-1,1-diphosphonic acid (HEDP);
2-[benzimidazolyl-(2,2)-]-ethane diphosphonic acid monohydrate;
2-[benzimidazolyl-(2,2)-]-ethane diphosphonic acid;
N-carboxymethane-1-aminoethane-1,1-diphophonic acid;
1,5-diaminopentane-1,1,5,5-tetraphosphonic acid, trihydrate;
α-octadecyl-phosphonosuccinic acid;
α-N-dodecylaminobenzylphosphonic acid;
β-trifluoromethyl-β-phosphonobutyric acid;
1-decylpyrrolidone-2,2-diphosphonic acid;
pyrrolidone-5,5-diphosphonic acid;
2,2-diphosphono-N-decylpyrrolidone;
γ,γ-diphosphono-N-methylbutyrolactam;
benzene phosphonous acid;
1,4-thiazine dioxide-N-methane diphosphonic acid;
p-(1,4-thiazine dioxide)-N-phenylene-hydroxymethane diphosphonic acid;
α-(1,4-thiazine dioxide)-N-ethane-α,α-diphosphonic acid;
3-(1,4-thiazine dioxide)-N-1-hydroxypropane-1,1-diphosphonic acid;
6-(1,4-thiazine dioxide)-N-1-hydroxyhexane-1,1-diphosphonic acid;
11-(1,4-thiazine dioxide)-N-1-hydroxyundecane-1,1-diphosphonic acid;
azacyclopentane-2,2-diphosphonic acid;
N-methylazacyclopentane-2,2-diphosphonic acid;
N-decylazacyclopentane-2,2-diphosphonic acid;
N-tetradecylazacyclopentane-2,2-diphosphonic acid;
azacyclohexane-2,2-diphosphonic acid;
1-(4,5-dihydro-3H-pyrrole-2-yl)-pyrrolidinylidene-2,2-diphosphonic acid;
hydroxymethane diphosphonic acid, $Na_2$ salt;
1-oxaethane-1,2-diphosphonic acid undecanehydrate, $Na_4$ salt;
1-hydroxypropane-1,1-diphosphonic acid;
1-hydroxypropane-1,1-diphosphonic acid, $Na_4$ salt;
1-hydroxybutane-1,1-diphosphonic acid heptadecanehydrate;
1-hydroxybutane-1,1-diphosphonic acid, $Na_3$ salt;
1-hydroxypentane-1,1-diphosphonic acid, $Na_4$ salt;
1-hydroxyoctane-1,1-diphosphonic acid, $Na_4$ salt.

In the treatment solution and the corresponding concentrate, the copolymer d) is preferably selected from copolymers of vinyl phosphonic acid and one or a plurality of unsaturated carboxylic acids selected from acrylic acid, methacrylic acid and maleic acid, their acid groups being able to be at least partially esterified with alcohols having 1 to 4 carbon atoms. A specific example is a vinyl phosphonic acid-acrylic acid copolymer, CAS-Nr. 27936-88-5. The molecular weight is in the range 30 000 to 90 000. This polymer is commercially available, for example, as a 20% aqueous solution with a total phosphorus content of 2.0±0.2 wt. %.

Preferably, the treatment solution comprises an additional polymer or copolymer from group f) that is particularly selected from maleic acid-methyl vinyl ether copolymers and from polymers or copolymers of acrylic acid and/or methacrylic acid, of which the carboxylic groups are at least partially substituted by amide groups. Instead of such a polymer, its ester with polyvinyl alcohol can also be used, which was described above as the polymer of group g).

In a further aspect, the present invention relates to a process for the production of colored layers on surfaces of zinc, aluminum, magnesium or their alloys, wherein the surfaces are brought into contact in the spray or dip process, for a period in the range of 2 seconds to 10 minutes, with an aqueous treatment solution according to the invention, which has a temperature in the range of 10 to 70° C.

With respect to the preferred treatment period, there exists a relationship between the concentration of the individual active substances and the time: the shorter the treatment period, then preferably the more concentrated is the treatment solution. Treatment times at the lower end of the range, for example in the range of 2 to about 10 seconds, can be used for the treatment of continuous metal strips. For the treatment of parts, treatment times are preferably selected in the range 0.5 to 3 minutes. The temperature of the treatment solution is preferably adjusted to at least 20° C. A maximum temperature of 60° C. is generally adequate.

The inventive treatment step is normally part of a treatment cycle, as is normal for a conversion treatment of the metal surfaces before a subsequent coating or adhesion step. A process cycle of this type generally starts with a cleaning/degreasing of the metal surfaces, using for example an alkaline cleanser. Then there are one or more rinsing steps with water. Then an acid treatment step can be carried out to remove surface oxides that are not removed in the alkaline cleaning step. This step is also known as "deoxidation" or "pickling" and is particularly employed for surfaces of aluminum and its alloys. After an intermediate rinse with water and preferably an additional rinse with deionized water, the inventive treatment step is then carried out with the inventive treatment solution. After this, there can be another water rinse. However, the process can also be carried out as a "no-rinse" process, i.e. rinsing with water after the inventive treatment step can be eliminated.

The result of this treatment cycle is a yellow colored, corrosion protected metal surface exhibiting a good adhesion to a subsequently coated layer based on organic polymers, for example a paint or an adhesive. This surface generally comprises 1 to 70 mg of titanium and/or zirconium per m2, particularly 3 to 30 mg/m2. The molybdenum and/or tungsten coating is generally in the range between 2 and 500 mg/m2. These values can be measured by means of standard methods of surface analysis, for example with X-ray fluorescence techniques. Therefore, the present invention also includes metal strips, metal sheet or metal parts that—as described above in more detail—possess surfaces of zinc, aluminum, magnesium or their alloys and carry colored layers on these surfaces that were produced with the inventive process. Here the metal strips, metal sheet or metal parts can be coated with a layer based on organic polymers, such as for example, a paint or an adhesive. The invention thus also includes metal strips, metal sheet or metal parts with the cited surfaces and which were treated using the inventive process and which were subsequently coated with a paint or glued to further component parts. For example, these metal strips, metal sheet or metal parts can have a powder-coated paint.

The inventive process thus delivers metal surfaces that possess a good corrosion resistance and a good paint adhesion, like the result known to the expert from the technically advantageous chromatizing process that is however, undesirable on ecological and health and safety grounds. Because of the coloration of the surface, the expert immediately sees whether the treatment has formed an adequate conversion layer just like he was used to with the chromatizing process. Thus, in comparison with the production of colorless conversion layers, the inventive process has the technical advantage that the result of the treatment is immediately visually recognizable, without the need for any special surface analysis technique.

EXAMPLES

Sample sheets of aluminum alloys AA 5005 and AA 6060 were pretreated as follows, as usual in industry, before the inventive process step:

Cleaning: Spraying with an alkaline cleanser (Ridoline® 124N 1.5%, Ridoline® 120WX, both commercial products of the applicant) 0.05%, 60° C., 1 minute
Rinsing: Mains water, room temperature, 0.5 minutes
Rinsing: Deionized water, room temperature, 0.5 minutes.

Then the inventive treatment step was carried out using the spray process according to Table 1, comparative examples V1 to V3 and examples B1 to B8.

Prior to the dip process of Example B9, the following pretreatments were made:

Cleaning: alkaline cleaner (P3-almeco® 18, a commercial product of the applicant) 3%, 60° C., 3 minutes
Rinsing: Mains water, room temperature, 0.5 minutes
Rinsing: Mains water, room temperature, 0.5 minutes
Pickling Deoxidizer® 4902 (a commercial product of the applicant) 2%, room temperature, 3 minutes
Rinsing: Mains water, room temperature, 0.5 minutes
Rinsing: Deionized water, room temperature, 0.5 minutes.

After the conversion treatment step according to Table 1, the sheets were rinsed with deionized water and dried and finally painted with a commercial polyester paint (storefront quality, white TGIC-free). Subsequently, an industry-standard test of the paint adhesion was then carried out. The sample sheets were provided with a cross cutting, stored 2 hours in boiling, deionized water and finally stored one hour at room temperature. An adhesive tape was then stuck over the cross cutting area and removed. The amount of paint removed from the sample sheet was determined and given cross cutting marks: Gt 0: no paint loss, Gt 5: extensive paint loss. The compositions of the treatment solutions and treatment results are shown in Table 1.

TABLE 1

Treatment solutions, treatment parameters and treatment results (V: non-inventive comparative solutions, B: inventive examples); concentrations in mg/l in water; treatment time: 1 minute; V1 to V3 and B1 to B8: spray treatment, B9: dip treatment.

| | V1 | V2 | V3 | B1 | B2 | B3 | B4 | B5 | B6 | B7 | B8 | B9 |
|---|---|---|---|---|---|---|---|---|---|---|---|---|
| Component | | | | | | | | | | | | |
| a) Hexafluorotitanic acid | 160 | 160 | 160 | 160 | 160 | 160 | 160 | 160 | 160 | 160 | 160 | 160 |
| b) Sodium molybdate, dihydrate | | 400 | 400 | 200 | 300 | 400 | 200 | 300 | 400 | 200 | 300 | 200 |
| c) 1-Hydroxyethane-1,1-diphosphonic acid, Na-salt | | 60 | | 30 | 45 | 60 | 30 | 45 | 60 | 30 | 45 | 30 |
| d) Vinylphosphonic acid-acrylic acid copolymer, CAS-Nr. 27936-88-5, Mol. Wt. 30 000 to 90 000 g/mol, Total phosphorus in polymer: 10 ± 1 wt. % | | | | 1 | 1.5 | 2 | 1 | 1.5 | 2 | 1 | 1.5 | 1 |
| e) Polyvinyl alcohol (Mol wt. 49 000) | 47.5 | 47.5 | 47.5 | 47.5 | 47.5 | 47.5 | 47.5 | 47.5 | 47.5 | 47.5 | 47.5 | 47.5 |
| f) Maleic acid-vinyl ether copolymer (Mol wt. 70 000) | 79.6 | 79.6 | 79.6 | 79.6 | 79.6 | 79.6 | 79.6 | 79.6 | 79.6 | | 79.6 | 79.6 |
| f) Polyacrylamide | | | | | | | | | | 79.6 | | |
| Tannin | 2 | 2 | 2 | 2 | 2 | 2 | 2 | 2 | 2 | 2 | | 2 |
| Methanol[1)] | 1.45 | 1.45 | 1.45 | 1.45 | 1.45 | 1.45 | 1.45 | 1.45 | 1.45 | 1.45 | 1.45 | 1.45 |
| Methyl acetate[1)] | 0.1 | 0.1 | 0.1 | 0.1 | 0.1 | 0.1 | 0.1 | 0.1 | 0.1 | 0.1 | 0.1 | 0.1 |
| pH | 3.7 | 3.1 | 3.1 | 3.1 | 3.1 | 3.1 | 3.1 | 3.1 | 3.1 | 3.1 | 3.1 | 2.7 |
| Temperature of the treatment solution (° C.) | 20 | 40 | 40 | 60 | 60 | 60 | 40 | 40 | 40 | 40 | 40 | 40 |
| Results: | | | | | | | | | | | | |
| Color of the layer | Colorless | yellow | yellow | light yellow | yellow | yellow | light yellow | light yellow | yellow | yellow | light yellow | light yellow |
| Cross cutting test (after 2 hours boiling in deionized water and 1 hour storage at room temperature) | Gt 0 | Gt 2-3 | Gt 5 | Gt 0 | Gt 0 | Gt 0 | Gt 0 | Gt 0 | Gt 0 | Gt 0 | Gt 0 | Gt 0 |

[1)]Additive in the polymer raw material, to which is assigned no technical function for the treatment solution.

What is claimed is:

1. An aqueous treatment solution for the production of colored layers on surfaces of zinc, aluminum, magnesium or their alloys, which contains:

a) a total of 4 to 4000 mg/l of hexafluorotitanate and/or hexafluorozirconate ions, b) a total of 10 to 4000 mg/l of molybdate and/or tungstate ions, calculated as dihydrate of the Na salt, c) a total of 1 to 2000 mg/l of one or more non-polymeric chelating complex formers, d) 0.04 to 40 mg/l of a copolymer of alkylene phosphonic or alkylene phosphinic acid and one or more unsaturated carboxylic acids;

e) polyvinyl alcohol or water-soluble or water-dispersible partial esters thereof in a concentration of at least 1 mg/l and at most 1000 mg/l; and further comprising one or more polymers, that are not part of d), selected from:

f) polymers or copolymers of amides of unsaturated mono or dicarboxylic acids, in a concentration of at least 1 mg/l and at most 300 mg/l;

g) esters of the polymers of groups e) and f) in a concentration of at least 1 mg/l and at most 300 mg/l;

h) 0.01 to 20 g/l of a polymer or copolymer of vinyl pyrrolidone;

i) amine-substituted polymers of 4-hydroxystyrene in a concentration of at least 1 mg/l and at most 2000 mg/l;

j) polymers of diglycidyl ethers of bisphenol A in a concentration of at least 1 mg/l and at most 2000 mg/l;

said treatment solution having a pH value in the range of 1 to 4.

2. The aqueous treatment solution according to claim 1, wherein:

the concentration of the hexafluorotitanate and/or hexafluorozirconate ions is at least 30 mg/l and is not more than 4000 mg/l; and/or the concentration of the molybdate and/or tungstate ions is at least 50 mg/l and is not more than 4000 mg/l; and/or the total concentration of the one or more non-polymeric chelating complex formers is at least 5 mg/l and is not more than 2000 mg/l; and/or the concentration of the copolymer of alkylene phosphonic or alkylene phosphinic acid and one or more unsaturated carboxylic acid(s) is at least 0.2 mg/l and is not more than 40 mg/l.

3. The aqueous treatment solution according to claim 1, wherein:

the concentration of the hexafluorotitanate and/or hexafluorozirconate ions is at least 4 mg/l and not more than 1000 mg/l; and/or the concentration of the molybdate and/or tungstate ions is at least 10 mg/l and not more than 2000 mg/l; and/or the total concentration of the one or more non-polymeric chelating complex formers is at least 1 mg/l and not more than 1000 mg/l; and/or the concentration of the copolymer of alkylene phosphonic or alkylene phosphinic acid and one or more unsaturated carboxylic acid(s) is at least 0.04 mg/l and not more than 10 mg/l.

4. An aqueous concentrate for the production or supplementation of an aqueous treatment solution according to claim 1 comprising:

b) a total of 2 to 200 g/l molybdate and/or tungstate ions, c) a total of 0.5 to 200 g/l of one or more non-polymeric chelating complex formers, d) 0.02 to 5 g/l of a copolymer of alkylene phosphonic or alkylene phosphinic acid and one or more unsaturated carboxylic acid(s).

5. The aqueous treatment solution according to claim 1, wherein the non-polymeric chelating complex former c) is selected from molecules with 2 or more phosphonic acid groups.

6. The aqueous treatment solution according to claim 1, wherein the copolymer d) is selected from copolymers of vinylphosphonic acid and one or more unsaturated carboxylic acids selected from acrylic acid, methacrylic acid and maleic acid.

7. The aqueous treatment solution according to claim 1, wherein the one or more polymers, that are not part of d), comprise at least one polymer or copolymer f) that is selected from maleic acid-methylvinylether copolymers and from polymers or copolymers of acrylic acid and/or methacrylic acid, of which the carboxyl groups are at least partially replaced by amide groups, or of which the esters are replaced with polyvinyl alcohol as polymer g).

8. The aqueous treatment solution according to claim 1, wherein:

the concentration of the hexafluorotitanate and/or hexafluorozirconate ions is at least 30 mg/l and is not more than 1000 mg/l;

the concentration of the molybdate and/or tungstate ions is at least 50 mg/l and is not more than 2000 mg/l l;

the total concentration of the one or more non-polymeric chelating complex formers is at least 5 mg/l and is not more than 1000 mg/l; and the concentration of the copolymer of alkylene phosphonic or alkylene phosphinic acid and one or more unsaturated carboxylic acid(s) is at least 0.2 mg/l and is not more than 10 mg/l.

9. The aqueous treatment solution according to claim 8, wherein the non-polymeric chelating complex former c) is selected from molecules with 2 or more phosphonic acid groups.

10. The aqueous treatment solution according to claim 8, wherein the copolymer d) is selected from copolymers of vinylphosphonic acid and one or more unsaturated carboxylic acids selected from acrylic acid, methacrylic acid and maleic acid.

11. The aqueous treatment solution according to claim 9, wherein the one or more polymers, that are not part of d), comprise at least one polymer or copolymer f) that is selected from maleic acid-methylvinylether copolymers and from polymers or copolymers of acrylic acid and/or methacrylic acid, of which the carboxyl groups are at least partially replaced by amide groups, or of which the esters are replaced with polyvinyl alcohol as polymer g).

12. An aqueous treatment solution for the production of colored layers on surfaces of zinc, aluminum, magnesium or their alloys, which consists of:

a) a total of 4 to 4000 mg/l of hexafluorotitanate and/or hexafluorozirconate ions, b) a total of 10 to 4000 mg/l of molybdate and/or tungstate ions, calculated as dihydrate of the Na salt, c) a total of 1 to 2000 mg/l of one or more chelating complex formers, d) 0.04 to 40 mg/l of a copolymer of alkylene phosphonic or alkylene phosphinic acid and one or more unsaturated carboxylic acids; and further comprising tannin; and optionally further comprising one or more polymers, that are not part of d), selected from:

e) polyvinyl alcohol or water-soluble or water-dispersible partial esters thereof in a concentration of at least 1 mg/l and at most 1000 mg/l;

f) polymers or copolymers of amides of unsaturated mono or dicarboxylic acids, in a concentration of at least 1 mg/l and at most 300 mg/l;

g) esters of the polymers of groups e) and f) in a concentration of at least 1 mg/l and at most 300 mg/l;

h) 0.01 to 20 g/l of a polymer or copolymer of vinyl pyrrolidone;

i) amine-substituted polymers of 4-hydroxystyrene in a concentration of at least 1 mg/l and at most 2000 mg/l;

j) polymers of diglycidyl ethers of bisphenol A in a concentration of at least 1 mg/l and at most 2000 mg/l;

said treatment solution having a pH value in the range of 1 to 4.

13. An aqueous concentrate for the production or supplementation of an aqueous treatment solution according to claim 12 comprising:

b) a total of 2 to 200 g/l molybdate and/or tungstate ions, c) a total of 0.5 to 200 g/l of one or more chelating complex formers, d) 0.02 to 5 g/l of a copolymer of alkylene phosphonic or alkylene phosphinic acid and one or more unsaturated carboxylic acid(s).

14. The aqueous treatment solution according to claim 12, wherein the chelating complex former c) is selected from molecules with 2 or more phosphonic acid groups.

15. The aqueous treatment solution according to claim 12, wherein the copolymer d) is selected from copolymers of vinylphosphonic acid and one or more unsaturated carboxylic acids selected from acrylic acid, methacrylic acid and maleic acid.

16. An aqueous treatment solution for the production of colored layers on surfaces of zinc, aluminum, magnesium or their alloys, which contains:

a) a total of 4 to 4000 mg/l of hexafluorotitanate and/or hexafluorozirconate ions, b) a total of 10 to 4000 mg/l of molybdate and/or tungstate ions, calculated as dihydrate of the Na salt, c) a total of 1 to 2000 mg/l of one or more chelating complex formers, d) 0.04 to 40 mg/l of a copolymer of alkylene phosphonic or alkylene phosphinic acid and one or more unsaturated carboxylic acids; and further comprising one or more polymers, that are not part of d), selected from:

e) polyvinyl alcohol or water-soluble or water-dispersible partial esters thereof in a concentration of at least 1 mg/l and at most 1000 mg/l;

f) polymers or copolymers of amides of unsaturated mono or dicarboxylic acids, in a concentration of at least 1 mg/l and at most 2000 mg/l;

g) esters of the polymers of groups e) and f) in a concentration of at least 1 mg/1 and at most 2000 mg/l;

h) 0.01 to 20 g/l of a polymer or copolymer of vinyl pyrrolidone;

i) amine-substituted polymers of 4-hydroxystyrene in a concentration of at least 1 mg/l and at most 2000 mg/l;

j) polymers of diglycidyl ethers of bisphenol A in a concentration of at least 1 mg/l and at most 2000 mg/l;

said treatment solution having a pH value in the range of 1 to 4;

wherein a vinyl phosphonic acid-acrylic acid copolymer having a molecular weight ranging between 30,000 and 90,000 g/mol is present as d) in an amount of 0.04 to 5 mg/l.

17. An aqueous treatment solution for the production of colored layers on surfaces of zinc, aluminum, magnesium or their alloys, which contains:

a) a total of 4 to 4000 mg/l of hexafluorotitanate and/or hexafluorozirconate ions, b) a total of 10 to 4000 mg/l of molybdate and/or tungstate ions, calculated as dihydrate of the Na salt, c) a total of 1 to 2000 mg/l of one or more non-polymeric chelating complex formers, d) 0.04 to 40 mg/l of a copolymer of alkylene phosphonic or alkylene phosphinic acid and one or more unsaturated carboxylic acids;

e) polyvinyl alcohol or water-soluble or water-dispersible partial esters thereof in a concentration of at least 1 mg/l and at most 1000 mg/l; and further comprising one or more polymers, that are not part of d), selected from:

f) polymers or copolymers of amides of unsaturated mono or dicarboxylic acids, in a concentration of at least 1 mg/l and at most 2000 mg/l;

g) esters of the polymers of groups e) and f) in a concentration of at least 1 mg/l and at most 2000 mg/l;

h) 0.01 to 20 g/l of a polymer or copolymer of vinyl pyrrolidone;

i) amine-substituted polymers of 4-hydroxystyrene in a concentration of at least 1 mg/l and at most 2000 mg/l;

j) polymers of diglycidyl ethers of bisphenol A in a concentration of at least 1 mg/l and at most 2000 mg/l;

said treatment solution having a pH value in the range of 1 to 4 wherein the one or more polymers, that are not part of d), comprise at least one polymer or copolymer f) that is a maleic acid-methylvinylether copolymer.

18. An aqueous treatment solution for the production of colored layers on surfaces of zinc, aluminum, magnesium or their alloys, which consists of:

a) a total of 4 to 4000 mg/l of hexafluorotitanate and/or hexafluorozirconate ions, b) a total of 10 to 4000 mg/l of molybdate and/or tungstate ions, calculated as dihydrate of the Na salt, c) a total of 1 to 2000 mg/l of one or more chelating complex formers, d) 0.04 to 40 mg/l of a copolymer of alkylene phosphonic or alkylene phosphinic acid and one or more unsaturated carboxylic acids; and further comprising tannin; and optionally further comprising one or more polymers, that are not part of d), selected from:

e) polyvinyl alcohol or water-soluble or water-dispersible partial esters thereof in a concentration of at least 1 mg/l and at most 1000 mg/l;

f) polymers or copolymers of amides of unsaturated mono or dicarboxylic acids, in a concentration of at least 1 mg/l and at most 2000 mg/l;

g) esters of the polymers of groups e) and f) in a concentration of at least 1 mg/l and at most 2000 mg/l;

h) 0.01 to 20 g/l of a polymer or copolymer of vinyl pyrrolidone;

i) amine-substituted polymers of 4-hydroxystyrene in a concentration of at least 1 mg/l and at most 2000 mg/l;

j) polymers of diglycidyl ethers of bisphenol A in a concentration of at least 1 mg/l and at most 2000 mg/l;

said treatment solution having a pH value in the range of 1 to 4;

wherein said optional one or more polymers, that are not part of d), are present and comprise at least:

e) polyvinyl alcohol or water-soluble or water-dispersible partial esters thereof present in a concentration of at least 1 mg/l and at most 1000 mg/l; and f) polymers or copolymers of amides of unsaturated mono or dicarboxylic acids, present in a concentration of at least 1 mg/l and at most 2000 mg/l.

* * * * *